US010208575B2

(12) United States Patent
Gohari et al.

(10) Patent No.: US 10,208,575 B2
(45) Date of Patent: Feb. 19, 2019

(54) ALTERNATIVE HELICAL FLOW CONTROL DEVICE FOR POLYMER INJECTION IN HORIZONTAL WELLS

(71) Applicant: BAKER HUGHES, A GE COMPANY, LLC, Houston, TX (US)

(72) Inventors: Kousha Gohari, Aberdeen (GB); Heikki Armas Jutila, Aberdeen (GB); Carlos Mascagnini, Aberdeen (GB); Christopher Harper, Aberdeen (GB); Peter J. Kidd, Forfar (GB)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 264 days.

(21) Appl. No.: 15/242,310

(22) Filed: Aug. 19, 2016

(65) Prior Publication Data

US 2018/0010428 A1 Jan. 11, 2018

Related U.S. Application Data

(63) Continuation-in-part of application No. 15/205,631, filed on Jul. 8, 2016.

(51) Int. Cl.

| | |
|---|---|
| ***E21B 43/12*** | (2006.01) |
| ***E21B 34/06*** | (2006.01) |
| *E21B 33/12* | (2006.01) |
| *E21B 43/14* | (2006.01) |
| *E21B 43/20* | (2006.01) |
| *E21B 43/32* | (2006.01) |

(52) U.S. Cl.

CPC ..... *E21B 43/12* (2013.01); *E21B 34/06* (2013.01); *E21B 33/12* (2013.01); *E21B 43/14* (2013.01); *E21B 43/20* (2013.01); *E21B 43/32* (2013.01)

(58) Field of Classification Search

CPC ..... E21B 33/12; E21B 33/138; E21B 34/06; E21B 43/12; E21B 43/14; E21B 43/20; E21B 43/32

See application file for complete search history.

(56) References Cited

U.S. PATENT DOCUMENTS

| | | | | |
|---|---|---|---|---|
| 5,803,179 | A * | 9/1998 | Echols | E21B 43/084 166/242.1 |
| 6,112,815 | A * | 9/2000 | Boe | E21B 43/086 166/242.1 |
| 6,302,194 | B1 * | 10/2001 | Kastner | F22B 37/103 122/6 A |
| 7,942,206 | B2 | 5/2011 | Huang et al. | |
| 8,925,633 | B2 | 1/2015 | Nguyen | |
| 2006/0196658 | A1 * | 9/2006 | Belcher | B65G 53/521 166/244.1 |
| 2009/0205834 | A1 * | 8/2009 | Garcia | E21B 34/08 166/373 |
| 2015/0204145 | A1 * | 7/2015 | Richards | E21B 17/026 166/380 |

* cited by examiner

*Primary Examiner* — Robert E Fuller
*Assistant Examiner* — Christopher J Sebesta
(74) *Attorney, Agent, or Firm* — Shawn Hunter

(57) ABSTRACT

The flow control device comprises one or more stacked spiral paths where the shape of an inlet to an end of a spiral has a taper on one or more sides to gradually increase the polymer velocity to eliminate rapid acceleration points as the flow enters the spiral path. The entrance with its taper can be curved to get into the spiral. The spiral can be entered tangentially or radially or axially.

17 Claims, 8 Drawing Sheets

ALTERNATIVE HELICAL FLOW CONTROL DEVICE FOR POLYMER INJECTION IN HORIZONTAL WELLS

RELATED APPLICATION DATA

This application is a continuation in part of application Ser. No. 15/205,631, filed on Jul. 8, 2016, and incorporated herein by reference in its entirety.

FIELD OF THE INVENTION

The field of the invention is flow control devices that balance flow and more particularly devices configured to minimize shear effects that adversely affect viscosity of injected polymers.

BACKGROUND OF THE INVENTION

Hydrocarbons such as oil and gas are recovered from a subterranean formation using a well or wellbore drilled into the formation. In some cases the wellbore is completed by placing a casing along the wellbore length and perforating the casing adjacent each production zone (hydrocarbon bearing zone) to extract fluids (such as oil and gas) from such a production zone. In other cases, the wellbore may be open hole. One or more flow control devices are placed in the wellbore to control the flow of fluids into the wellbore. These flow control devices and production zones are generally separated from each other by installing a packer between them. Fluid from each production zone entering the wellbore is drawn into a tubing that runs to the surface. It is desirable to have a substantially even flow of fluid along the production zone. Uneven drainage may result in undesirable conditions such as invasion of a gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil.

A deviated or horizontal wellbore is often drilled into a production zone to extract fluid therefrom. Several inflow control devices are placed spaced apart along such a wellbore to drain formation fluid or to inject a fluid into the formation. Formation fluid often contains a layer of oil, a layer of water below the oil and a layer of gas above the oil. For production wells, the horizontal wellbore is typically placed above the water layer. The boundary layers of oil, water and gas may not be even along the entire length of the horizontal well. Also, certain properties of the formation, such as porosity and permeability, may not be the same along the well length. Therefore, fluid between the formation and the wellbore may not flow evenly through the inflow control devices. For production wellbores, it is desirable to have a relatively even flow of the production fluid into the wellbore and also to inhibit the flow of water and gas through each inflow control device. Active flow control devices have been used to control the fluid from the formation into the wellbores. Such devices are relatively expensive and include moving parts, which require maintenance and may not be very reliable over the life of the wellbore. Passive inflow control devices ("ICDs") that are able to restrict flow of water and gas into the wellbore are therefore desirable.

Horizontal wells for injection and production are used to help maximize the sweep efficiency and economic recovery; especially for recovery of viscous oil in offshore environments. Flow control devices (FCDs) are readily used to control the flow along the well in conventional recovery operations leading to improved recovery efficiency. The benefits of polymer flooding and FCDs has been well demonstrated, however the combination of the two technologies has yet to be fully realized. The cause of FCDs not being as utilized in polymer injection application is due to the severe degradation of the polymer through devices.

Polymer flooding has good potential as an enhanced oil recovery (EOR) option especially for higher conductivity, mature and heavier oil reservoirs. The technique is simply viscosifying the injection water in order to increase the effectiveness of the flooding hence achieving improved sweep efficiency. The polymer is designed in a manner that ensures that the oil phase has a more favourable mobility ratio compared to the pure water injection while working in an injection strategy that has been deemed optimum for the field. Therefore the effectiveness of the polymer flooding strategy is highly dependent on the viscosity of the polymer.

Polymer enhanced oil recovery has been used as an alternative to water flooding to achieve better sweep efficiency; it works by viscosifying the water in order to get a favourable mobility ratio for the oil, hence maintaining the viscosity of the polymer is imperative to the success of the polymer. However as the polymer viscosity increases the frictional effects increase, this becomes much more critical in long horizontal wellbores. Depending on the reservoir quality there may be a significant heel-to-toe effect occurring hence a significant injection flux will occur in the heel and other higher reservoir quality or low pressure environments rather than the entire length of the horizontal wellbore. Hence this impacts the recovery efficiency. Flow control devices and valves can be used to even out the injection flux along the wellbore increasing the recovery efficiency. However the problem with most flow control systems is that it shears the polymer affecting the polymer viscosity. However the present invention illustrates a specific design that can be implemented to significantly minimize the unwanted shearing of the polymer while still providing the equalization of injection flux along the wellbore.

From an economical point of view it is critical that the completion strategy does not adversely impact the polymer quality that would lead to an increase in polymer loading in order to achieve the desired polymer viscosity for the optimum sweep efficiency. Hence the following question emerges: Should Flow Control Devices (FCDs) be utilized when considering that the completion strategy for the injectors should be to eliminate potential nodes that may cause excessively shearing of the polymer? While it has been well understood in the industry that implementation of FCDs can lead to higher recovery efficiency and delaying unwanted fluid breakthrough less is understood about the impact for polymer injectors.

Inflow control devices for production applications are described in U.S. Pat. No. 8,403,038 and shown in some detail in FIGS. 1 and 2. These FIGS. use a velocity profile to illustrate restriction points that cause problems when used for polymer injection where excessive shear alters the polymer viscosity and alters the needed flow rates to achieve the desired production enhancement result from the injection. Other art relating to inflow control devices is US 2009/0205834, U.S. Pat. No. 7,942,206 and U.S. Pat. No. 8,925,633.

FIGS. 1 and 2 show two rotated views of an inflow control device described in U.S. Pat. No. 8,403,038 and designed to perform differently depending on the viscosity of the fluids being produced through it. It features an inlet 10 that leads to spaced inlet passages 12 and 14 that continues into a zig-zag flow regime 16 while moving axially initially in the direction of arrow 18. A direction change occurs at 20 and the zig-zag motion continues as the fluid now travels in the direction of arrow 22 through straight transition passage 24. As seen in FIG. 2 after passage 24 the flow continues in a zig-zag fashion in the direction of arrow 18 to emerge at an outlet 26. Typically after a movement in a circumferential direction clockwise, for example, the flow goes through a small transition passage 30 to continue flowing circumferentially in a counterclockwise direction. The transition passages are offset from adjacent transition passages 30 to induce the zig-zag flow pattern to get the needed pressure drop for inflow control. Flow tests have shown that there are high velocities and inlet passages 12 and 14 as well as at or just past the transition passages 30. While FIGS. 1 and 2 show a single zig-zag movement in the direction of arrow 18 with a transition passage 24 the design can have multiple such generally axially oriented flow arrangements to get the desired pressure drop for a predetermined flow rate. The problem with using such a device or an alternative device shown in FIG. 3 is that there are high velocity regions which cause fluid shearing that if polymer was used through such devices for balancing flow in an injection application, the result would be excessive shear that adversely affects the viscosity of the polymer. It is important to assure that the volume of polymer concentration is maintained and the device is able to effectively balance flow for the polymer phase injection while also balancing flow for different injection fluid phases (i.e. pure water, steam, etc.) that are injected along with or a different times. It has been realized that to effectively inject polymer through a flow balancing device a key design parameter is to reduce high velocity zones that cause shear that adversely affects the viscosity of the polymer that is being injected.

FIG. 3 is another known inflow control device that features a flow inlet 40 leading to an inlet passage 42 followed by a spiral flow pattern to an outlet 44. The velocity at the inlet passage 42 would cause shear affects for the polymer that would adversely affect its viscosity.

What is needed and provided by the present invention is a flow distribution device for polymer injection operation that has a configuration of reducing shear effects on the polymer to minimize adverse effects on its viscosity. Some of the ways this is accomplished is a broad circumferential inlet to a flow path that is circumferentially oriented while providing a zig-zag flow pattern that uses large transition passages to get the zig-zag flow effect which is a design feature enabled by the circumferential orientation of the zig-zag flow. Another way is to introduce the polymer into one or more stacked spiral paths where the entrance to the spiral is a taper that gradually increases polymer velocity and eliminates rapid acceleration approaching the entrance to the spiral. These and other aspects of the device and polymer injection method using the device will be more readily apparent to those skilled in the art from a review of the detailed description of the preferred embodiment and the associated drawings while recognizing that the full scope of the invention is to be found in the appended claims.

SUMMARY OF THE INVENTION

A flow balancing device facilitates polymer injection in a horizontal formation in a manner that minimizes shear effects on the injected polymer. Features of the device reduce velocity using a broad circumferentially oriented inlet plenum that leads to a circumferentially oriented path having zig-zag fluid movement characterized by broad passages that define the zig-zag pattern so as to reduce velocity at such transition locations. Because the path is circumferentially oriented there is room for broad transition passages independent of the housing diameter. The broad crescent shaped inlet plenum also reduces inlet velocity to preserve the viscosity of the injected polymer. Other materials can be injected or the device can be employed in production service as well as injection. A related method employs the described device for injection.

In another embodiment the flow control device comprises one or more stacked spiral paths where the shape of an inlet to an end of a spiral has a taper on one or more sides to gradually increase the polymer velocity and eliminates the rapid acceleration as the flow enters the spiral path. The entrance with its taper can be curved to get into the spiral. The spiral can be entered tangentially or radially or axially.

DETAILED DESCRIPTION OF THE PREFERRED EMBODIMENT

Figure 4:
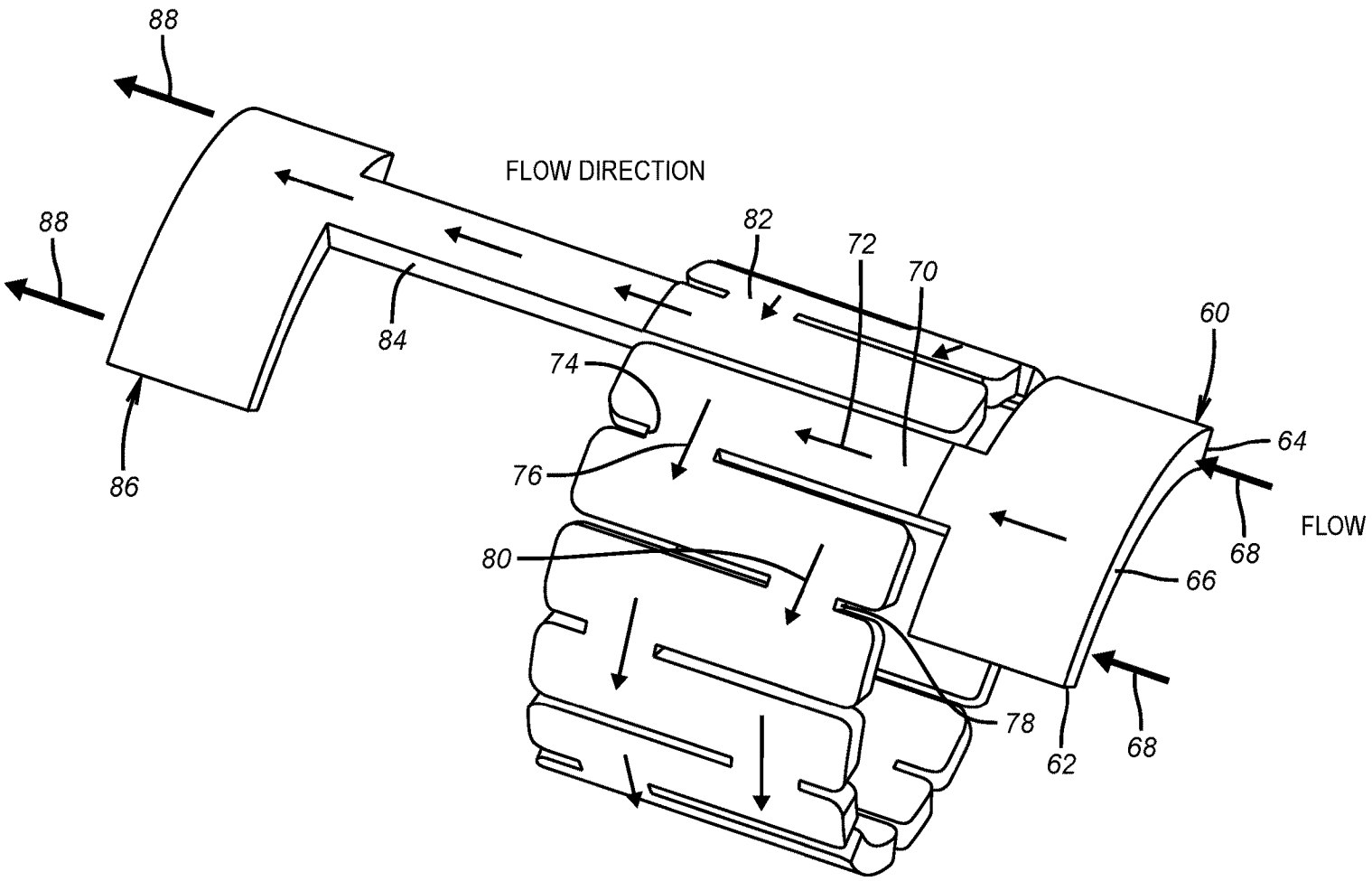
FIG. 4 shows the orientation of the inlet and circumferential flow path leading to the outlet in the present invention.

FIG. 4 shows the flow path in the device without the outer housing for greater clarity. The inlet 60 extends between opposed ends 62 and 64 in between which is a height 66 so that the inlet flow represented by arrows is aligned with the crescent-shaped opening or slot that defines the inlet 60. From there the flow goes axially into passage 70 as indicated by arrow 72 and then turns circumferentially into passage 74 as indicated by arrow 76. Transition passage 78 is axially and circumferentially offset from passage 74 to induce the zig-zag flow pattern that repeats as the flow goes back and forth axially as it progresses circumferentially until reaching passage 82 to move into axial path 84 for continuation to the outlet 86 which has the same crescent shape of inlet 60 and results in flow indicated by arrows 88 exiting axially from the outlet 86 to minimize the exit velocity from the broad outlet and elimination of turns using the axial flow out of outlet 86 as indicated by arrows 88.

Variations are contemplated such as when flow exits passage 82 and enters passage 84 for axial flow, another circumferential zig-zag array can be entered or the path can continue as a scroll with a smaller diameter than the initial circumferential pass. More than two circular paths are also envisioned. The length of each axial path can be varied. What is shown is the axial paths such as 70 extending about half way between the inlet 60 and the outlet 86 with each axial path equally long. This can be varied so that the axial paths can extend further or less than shown to the point where they extend the full distance between the inlet 60 and the outlet 86. The axial paths in a given circular path can have different or the same lengths. The crossover passages between the axial runs such as 74, 76 and 82 can have the same cross-sectional areas or different areas. The shape of such openings is preferably rectangular but can also be square, round or another shape that promotes smooth flow therethrough to reduce shear effects from high velocity zones. The opening shapes for crossover passages between the axial runs such as 74, 76 and 82 can be the same or different. Since the flow regime is circumferential there is always room to extend the length of the passages such as 74 independently of the housing that is around the structure of FIG. 4 that is not shown.

The circumferential paths that can be used can be stacked axially and have the same diameter. The flow through multiple paths stacked axially can be in series or in parallel. The diameter of the circumferential paths can be the same or different. Multiple circumferential paths can also be partially or totally nested axially which means they will have differing diameters and can have series or parallel flow. Parallel flows involve multiple inlets and outlets that can be configured to be side by side in a circular array or radially nested in whole or in part with different diameters to allow for the nesting. The inlet opening 66 can have an inlet flare such as a taper or a rounded edge to reduce turbulence and resulting fluid shear that can stem from such turbulence.

Figure 1:
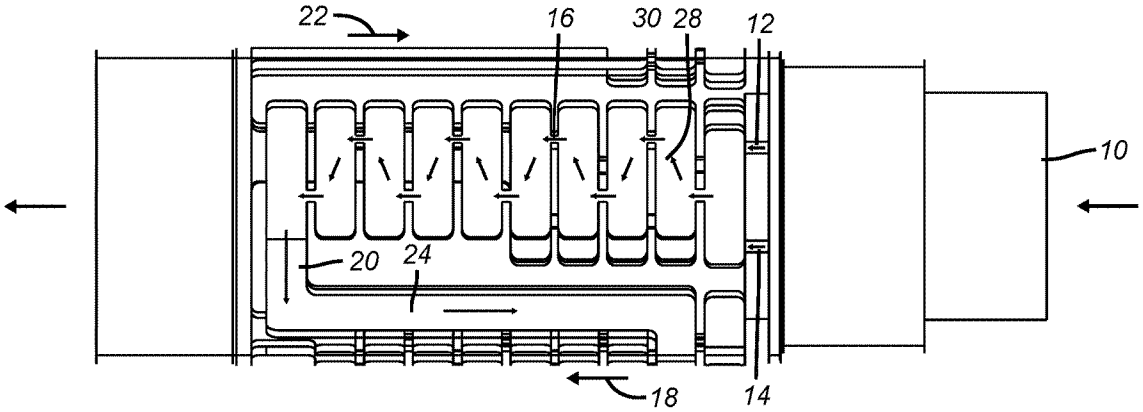
(PRIOR ART) FIG. 1
FIG. 1 is a schematic view of a prior art device from a first orientation showing entering flow.
Figure 2:
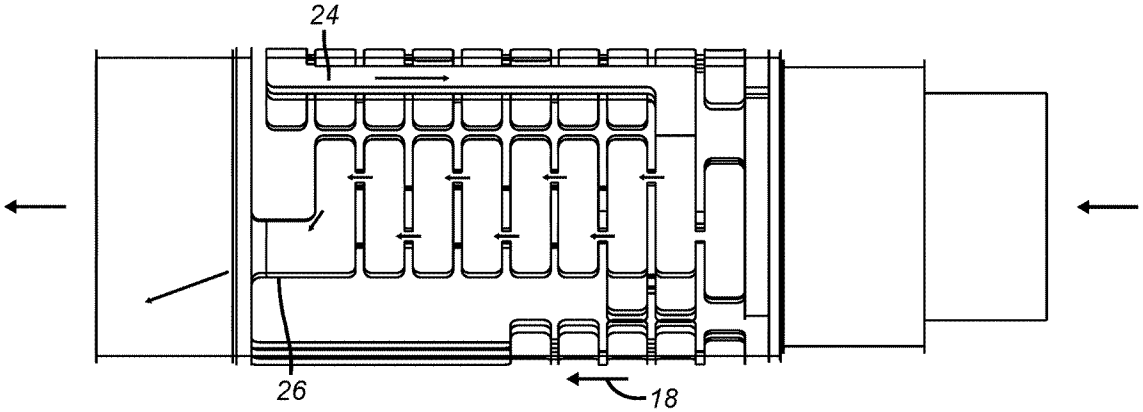
(PRIOR ART) FIG. 2
FIG. 2 is the view of FIG. 1 slightly rotated to show the exiting flow.
Figure 3:
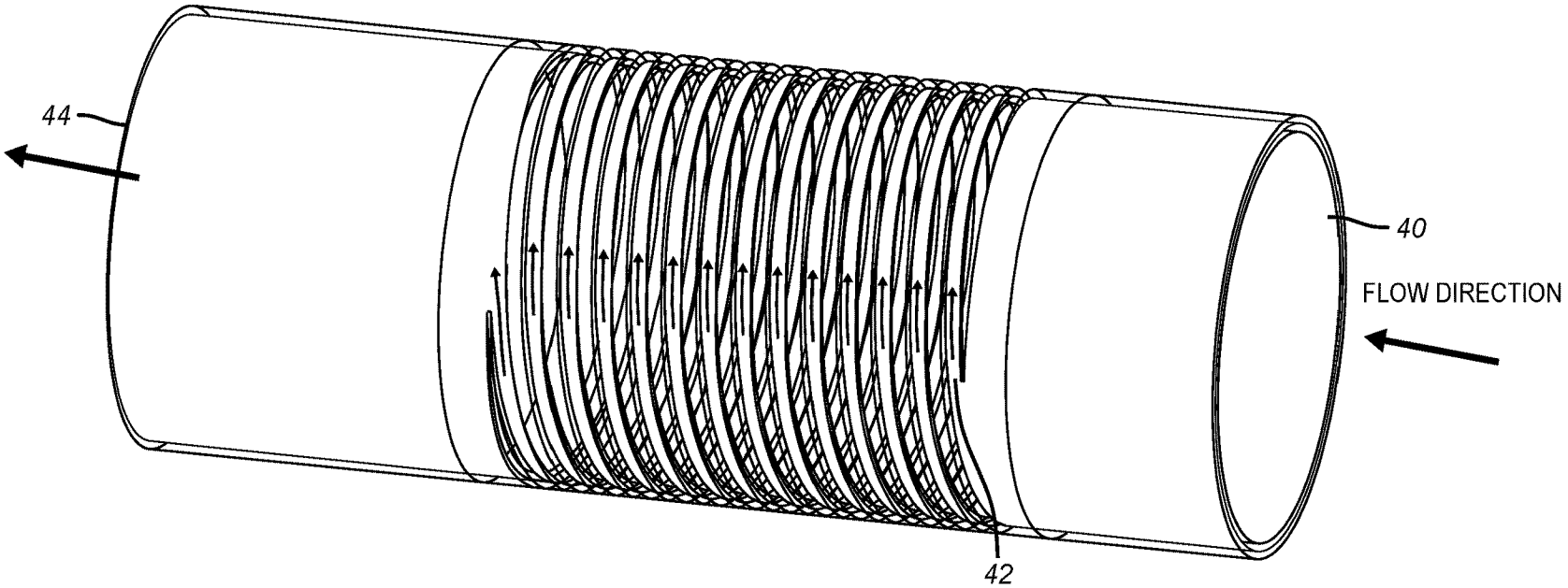
(PRIOR ART) FIG. 3
FIG. 3 is another prior art inflow control device featuring a spiral flow path.
Figure 5:
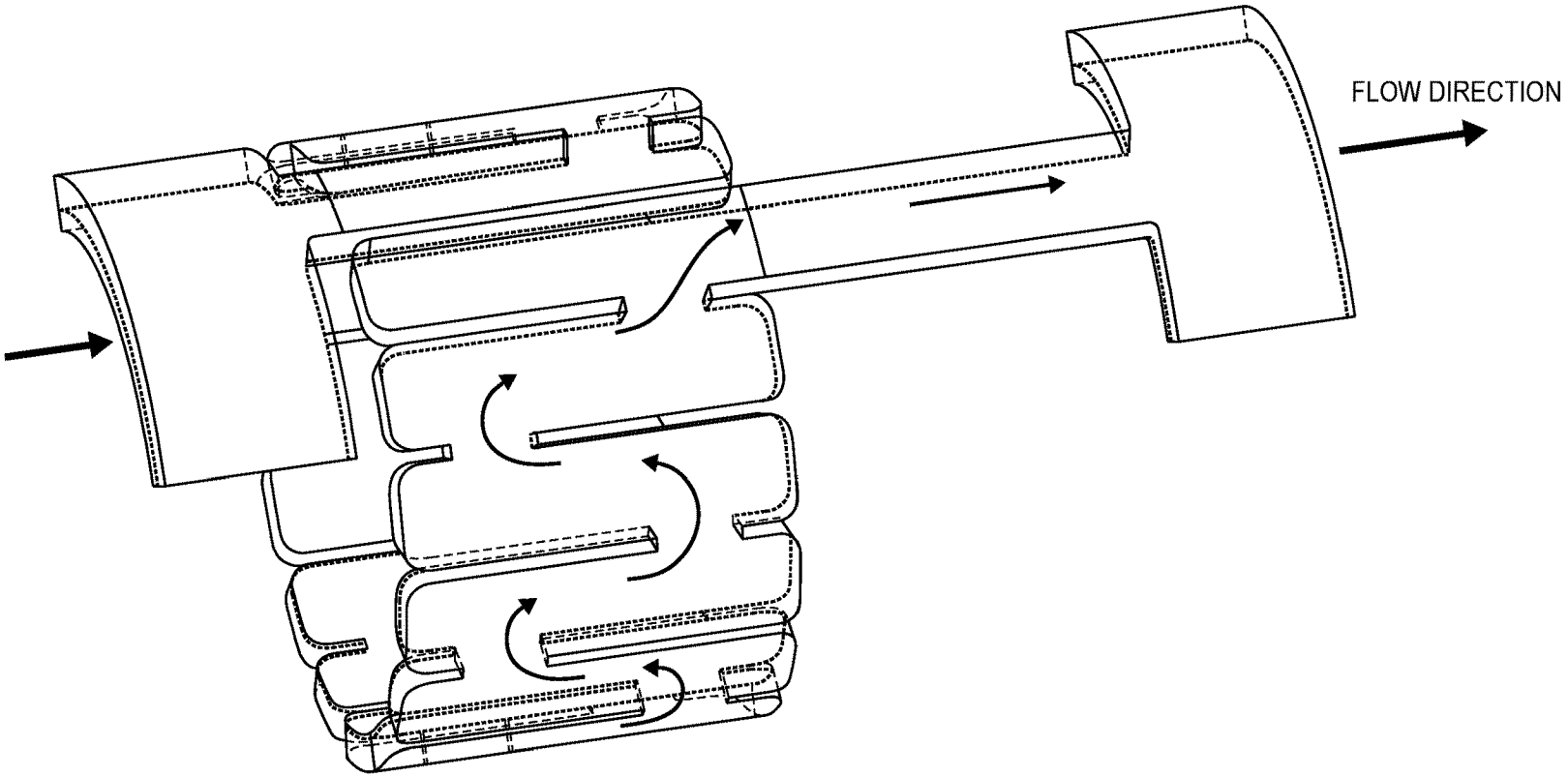
FIG. 5 is the view of FIG. 4 showing the velocity of the flow.
Figure 6:
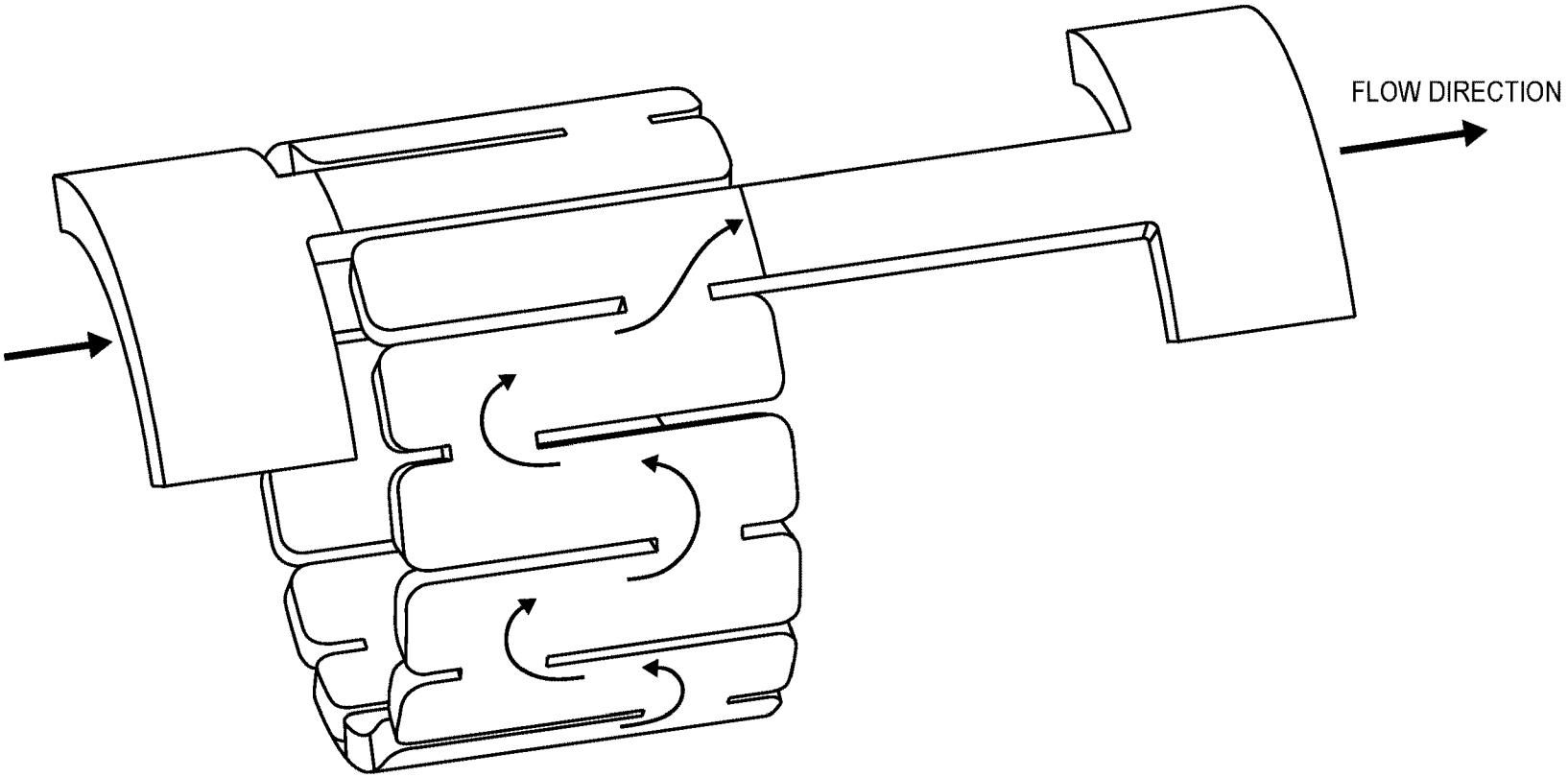
FIG. 6 is the view of FIG. 4 showing the wall shear from the flow.
Figure 7:
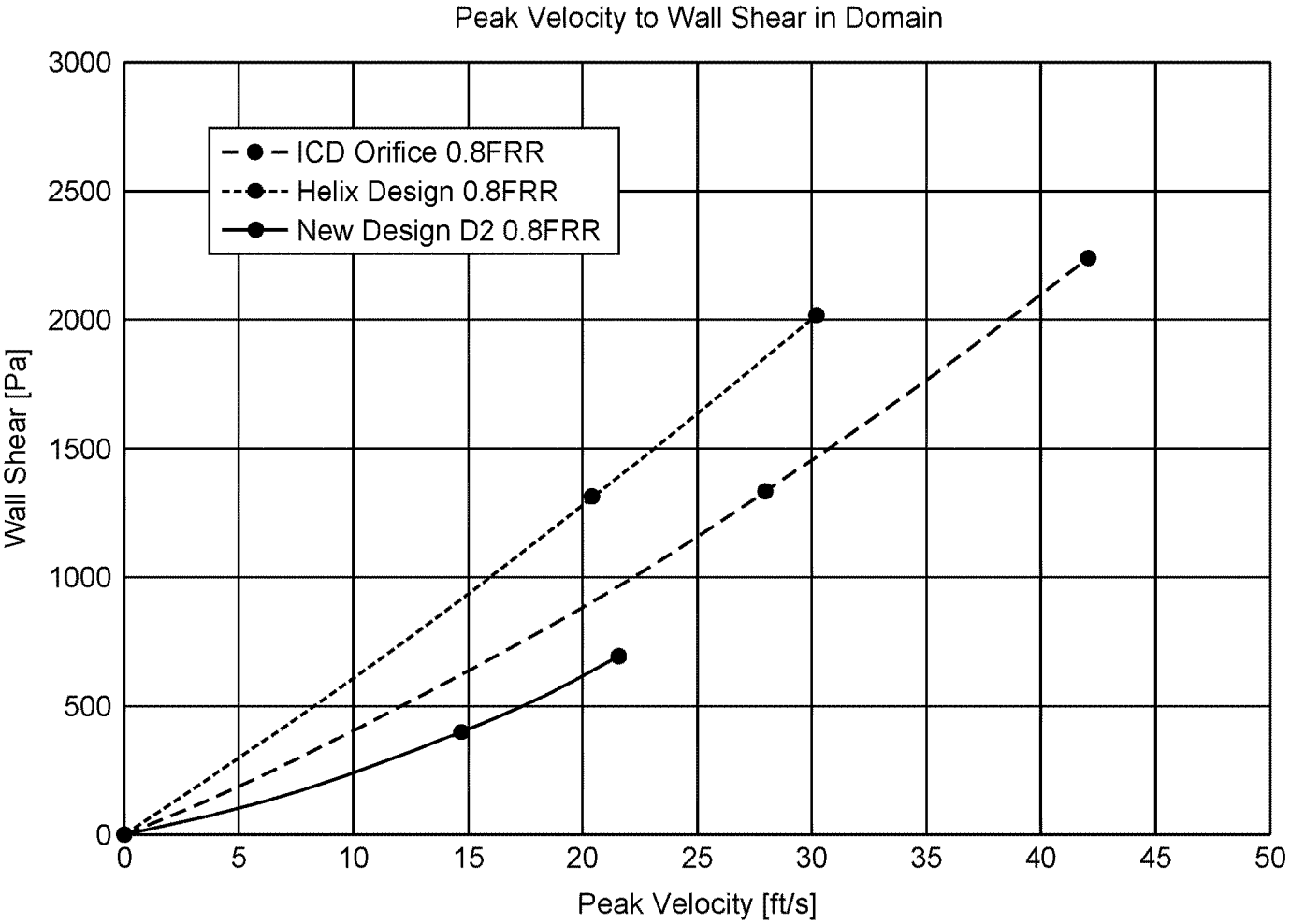
FIG. 7 is a performance graph showing the relatively lower velocities and wall shear of the present invention compared to the FIGS. 1-3 designs.

FIGS. 5 and 6 respectively illustrate the velocity through the device illustrated in FIG. 4 and the wall shear. FIG. 7 is a graph with the top line representing the performance of the FIG. 3 device and the middle line the performance of the FIGS. 1 and 2 device. The present invention shown in FIG. 4 has its performance illustrated in the lowest line indicating that the peak velocities are lower which results in a lower wall shear than the known designs of FIGS. 1-3 for a given flow rate.

The FIG. 4 devices can be used in injection methods to balance flow while minimizing shear effects on a polymer or for injection other materials or even for producing from a formation.

Figures 8, 8A:
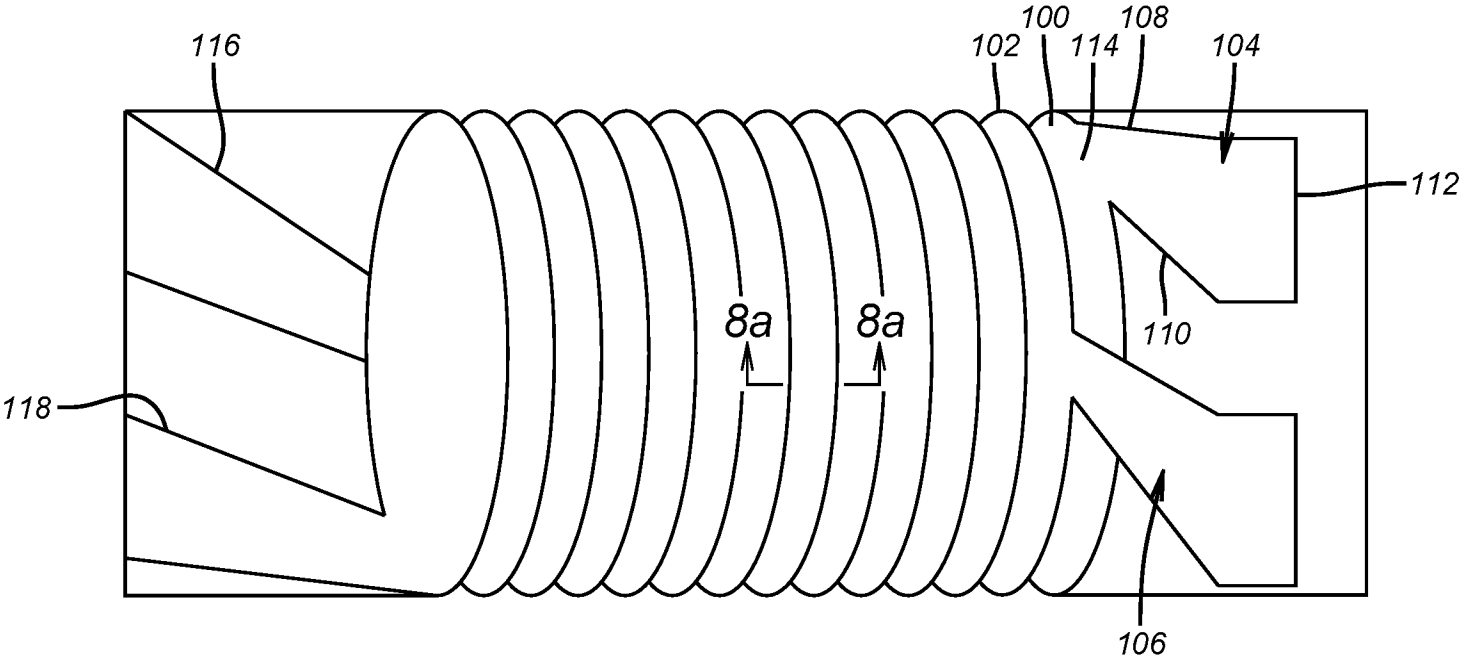
FIGS. 8 and 8*a* illustrate an inlet taper configuration oriented tangentially and radially having a round cross-section.

Referring now to FIG. 8, a dual stacked spiral shape comprising coils 100 and 102 has respective inlet shapes 104 and 106 and an outer periphery 111. Inlet 104 has opposed sides 108 and 110 at least one of which is tapered toward the other such that the cross-sectional area at 112 is larger than the area at location 114 at the coil 100 inlet. As a result the injected polymer flowing from 112 into coil 100 increases in velocity gradually and eliminates rapid acceleration points as observed in alternative designs seen in FIG. 3 at item 42. The degree of wall taper is somewhat dependent on the available space but taper angles of 30 degrees or less are contemplated. A cross-sectional area difference over the length of the inlet can be as much as 50% and the length of the inlet can be as long as half the axial length of the associated coiled path. As shown with inlet 104 the entry orientation is tangential while the inlet 106 is illustrated as radial. Outlets 116 and 118 are shown in a more axial orientation and the illustrated inlets 104 and 106 can alternatively be oriented in a more axial orientation the same as the illustrated outlets putting them within about 30 degrees of the longitudinal axis. Although two stacked coils are shown one or more than two coils can be used. The tapers for the inlets gradually increase the injected polymer velocity to control the amount of shearing of the polymer that can adversely affect its physical properties and the needed injection rate to get the optimum production benefit from the formation.

Figures 9, 9A:
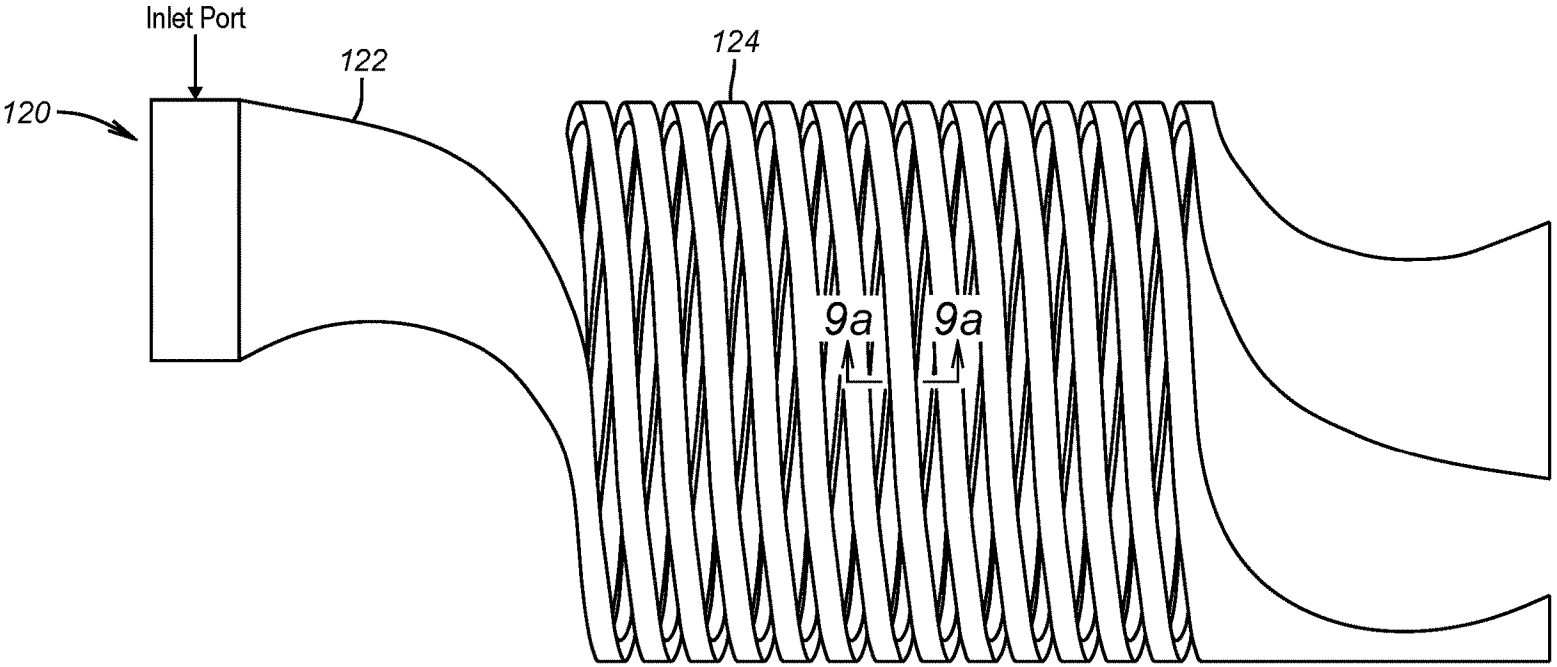
FIGS. 9 and 9*a* show a tapering inlet that tracks the spiral curvature of the restriction path with the path having a quadrilateral cross-section.

FIG. 9 shows an axially oriented connection 120 that reduces in cross-sectional area 122 gradually as it turns to tangentially enter the coiled section 124. Here the cross-section is round and decreasing in diameter at the same time it is being coiled to enter the coil 124 tangentially which also reduces the shear effect on the polymer being pumped through. The outlet can have the same tapering feature but with the diameter growing as the flow exits the coil 124. As in the FIG. 8 version the inlet orientation can be axial or radial and the inlet cross-section can also be a quadrilateral or some other shape that gradually transitions to a smaller dimension to incrementally so as to minimize the shearing effect on the pumped polymer that flows through.

The above description is illustrative of the preferred embodiment and many modifications may be made by those skilled in the art without departing from the invention whose scope is to be determined from the literal and equivalent scope of the claims below:

We claim:

1. A flow control assembly for borehole use, comprising:

at least one housing having opposed end connections adapted for connection to a tubular string;

at least one coiled path defining an outer periphery and having at least one inlet and at least one outlet and disposed in said housing, the at least one inlet extending spirally and axially about an axis of the housing in general alignment with the periphery of said at least one coiled path, said inlet and outlet communicating with pressure in the tubular string, said inlet comprising, from said housing, a continuing reduction in cross-sectional area while following the outer periphery of said at least one coiled path in the direction of fluid movement into said inlet for reduction of shear effect on fluid traversing said inlet.

2. The assembly of claim 1, wherein:

said reduction in cross-sectional area occurs in the form of a taper.

3. The assembly of claim 1, wherein:

said inlet comprising at least one tapered flat side to accomplish said reduction in cross-sectional area.

4. The assembly of claim 1, wherein:

said inlet cross-section shape at least at said coiled path is round.

5. The assembly of claim 1, wherein:

said inlet cross-sectional shape at least at said coiled path is a quadrilateral.

6. The assembly of claim 1, wherein:

said inlet enters said coiled path tangentially.

7. The assembly of claim 1, wherein:

said inlet enters said coiled path radially.

8. The assembly of claim 1, wherein:

said inlet enters said coiled path axially.

9. The assembly of claim 1, wherein:

said at least one coiled path comprises a plurality of nested discrete coiled paths that do not communicate with each other along a coiled path length.

10. The assembly of claim 9, wherein:

each said coiled paths has a said inlet where adjacent inlets are offset from each other.

11. The assembly of claim 1, wherein:

said inlet tapers to a smaller dimension and is coiled so that an end of said inlet aligns axially with an opposing end of the coiled path.

12. The assembly of claim 1, wherein:

said inlet has a taper angle of as much as 30 degrees.

13. The assembly of claim 1, wherein:

the cross-sectional area of said inlet decreases by as much as 50% over a length of said inlet, said inlet length being up to half the axial length of said coiled path.

14. A borehole flow balancing method for production or injection, comprising:

flowing through a tubular string sting in the borehole that further comprises at least one housing having opposed end connections adapted for connection to the tubular string and at least one coiled path defining an outer periphery and comprising at least one inlet and at least one outlet and disposed in said housing, the at least one inlet extending spirally and axially about an axis of the housing in general alignment with the outer periphery of said at least one coiled path, said inlet and outlet communicating with pressure in the tubular string, said inlet comprising, from said housing, a continuing reduction in cross-sectional area while following the outer periphery of said at least one coiled path in the direction of fluid movement into said inlet for reduction of shear effect on fluid traversing said inlet.

15. The method of claim 14, comprising:

providing at least one tapered flat side to accomplish said reduction in cross-sectional area.

16. The method of claim 14, comprising:

configuring said inlet to enter said coiled path, tangentially, radially or axially.

17. The method of claim 14, comprising:

providing as said at least one coiled path a plurality of nested coiled paths wherein each said coiled paths has a said inlet where adjacent inlets are offset from each other.

* * * * *